US007014133B2

(12) United States Patent
Ho

(10) Patent No.: US 7,014,133 B2
(45) Date of Patent: Mar. 21, 2006

(54) MECHANICAL DELAYING DEVICE OF SHREDDER

(76) Inventor: Ming-Hui Ho, No. 18, 20 Lane, Hsin Feng Street, Hsin Chuang City, Taipei Shien (TW)

( * ) Notice: Subject to any disclaimer, the term of this patent is extended or adjusted under 35 U.S.C. 154(b) by 212 days.

(21) Appl. No.: 10/634,960

(22) Filed: Aug. 6, 2003

(65) Prior Publication Data

US 2005/0029375 A1 Feb. 10, 2005

(51) Int. Cl.
*B02C 25/00* (2006.01)
*B02C 23/00* (2006.01)

(52) U.S. Cl. ..... 241/36; 241/100; 241/236

(58) Field of Classification Search ..... 241/36, 241/236

See application file for complete search history.

(56) References Cited

U.S. PATENT DOCUMENTS 5,167,374 A * 12/1992 Strohmeyer ..... 241/36
5,775,605 A 7/1998 Tsai
5,984,215 A 11/1999 Huang
6,213,417 B1 * 4/2001 Schwelling ..... 241/36
6,250,574 B1 * 6/2001 Wu Huang ..... 241/36
6,308,904 B1 * 10/2001 Chang ..... 241/36
6,802,465 B1 * 10/2004 Norcott et al. ..... 241/36
6,827,300 B1 * 12/2004 Lee ..... 241/36

* cited by examiner

*Primary Examiner*—Derris H. Banks
*Assistant Examiner*—Jason Y Pahng
(74) *Attorney, Agent, or Firm*—Bacon & Thomas PLLC

(57) ABSTRACT

A mechanical delaying device of a shredder includes a lever connected with a spindle at frames of blade assemblies, a roller accommodated around a shaft at an end of the lever, a baffle fastened at an end of the shaft, a spring disposed between the roller and the baffle, and a helical cam disposed at an outer side of a fixing plate of one of the blade assemblies. When paper is not inserted, the roller presses against the spring and blocks at an outer end of the cam. When paper is inserted, paper is pressed downward for driving and rotating the spindle such that the roller is displaced outward from the cam. A restoring force of the spring pushes the roller inward. The roller follows the cam as the cam is rotated by the blade assemblies, driving the roller to an outermost end of the cam, thereby accomplishing delaying and halting purposes.

2 Claims, 3 Drawing Sheets

MECHANICAL DELAYING DEVICE OF SHREDDER

BACKGROUND OF THE INVENTION (a) Field of the Invention

The invention relates to shredder having a delaying and halting device using a spindle, a roller and a gear axis, and being capable of overcoming drawbacks as short-circuits and malfunctions of prior electronic delaying devices, thereby lengthening lifespan of the shredder.

(b) Description of the Prior Art

Common delaying devices of shredders usually adopt electronic components such as printed circuit boards, sensors and the like. However, these electronic delaying devices frequently result in malfunctions in the shredders due to humidity or poor contacts.

SUMMARY OF THE INVENTION

The primary object of the invention is to provide a shredder having spindle at frames of blade assemblies, a roller or cam follower accommodated around a shaft connected at a bottom portion of a lever at one end of the spindle, and a projecting helical gear or helical cam at an outer side of a fixing plate of the blade assemblies. Using an interlocking relationship by engaging the cam follower with the helical cam, mechanical delaying and halting purposes are accomplished after inserting paper.

DETAILED DESCRIPTION OF THE PREFERRED EMBODIMENTS

To better understand the invention, detailed descriptions shall be given with the accompanying drawings hereunder.

Figure 1:
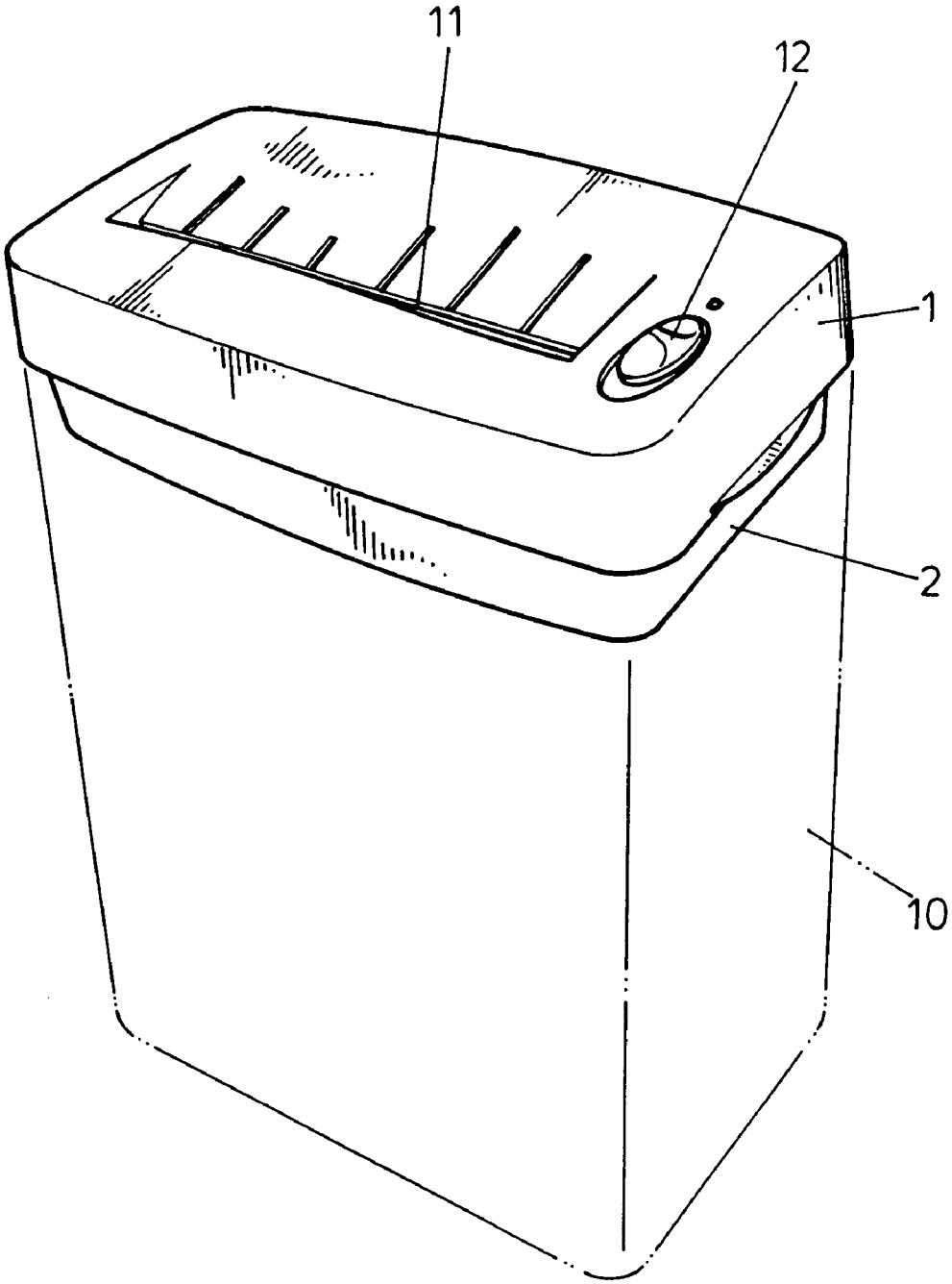
FIG. 1 shows an elevational view according to the invention.
Figure 2:
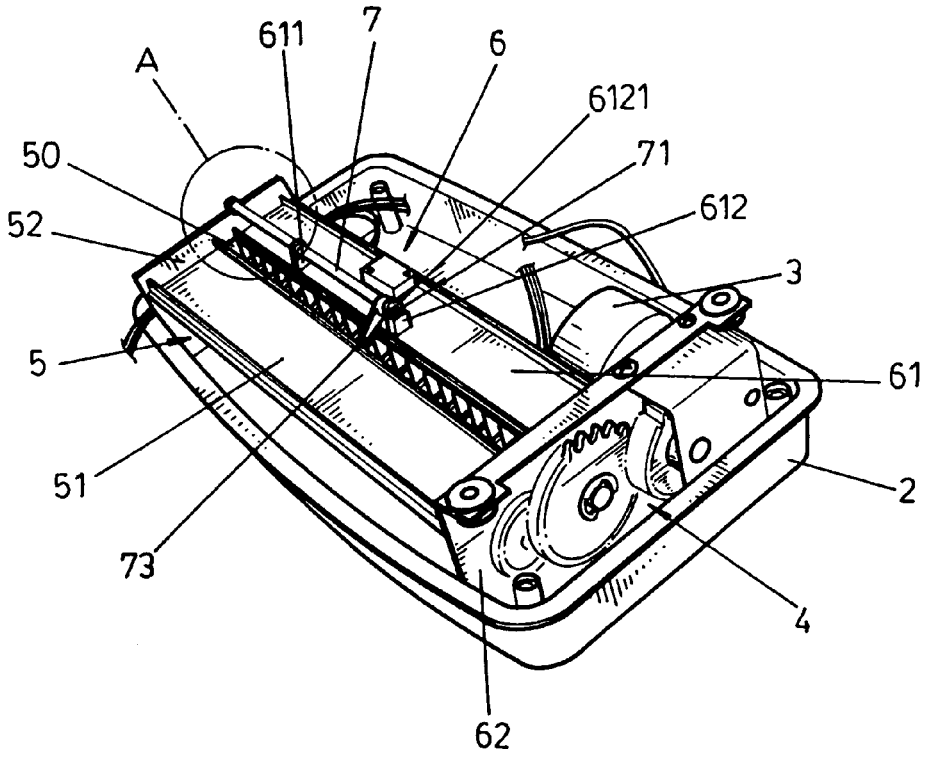
FIG. 2 shows a partial structural view according to the invention.

Referring to FIGS. 1 and 2, the invention comprises an upper lid 1, a base 2, a motor 3, a decelerator (or reduction gear set) 4, and two blade assemblies 5 and 6. The upper lid 1 has a feeder 11 and a switch button 12 at a top portion thereof. The base 2 accommodates the motor 3, the decelerator 4, and the two blade assemblies 5 and 6 at an interior thereof, and has a shred container 10 at a bottom portion thereof. The motor 3 is for driving and rotating the decelerator 4, which consists of a plurality of gears, and the decelerator 4 is for driving and rotating the two blade assemblies 5 and 6, thereby shredding paper. The two blade assemblies 5 and 6 are provided with U-shaped plastic frames 51 and 61 that have openings thereof facing outward, so as to form a long shredder slot 50 connected with the feeder 11 of the upper lid 1. The frames 51 and 61 of the two blade assemblies 5 and 6 are fastened at metal fixing plates 52 and 62 via two sides thereof, respectively.

Figure 3:
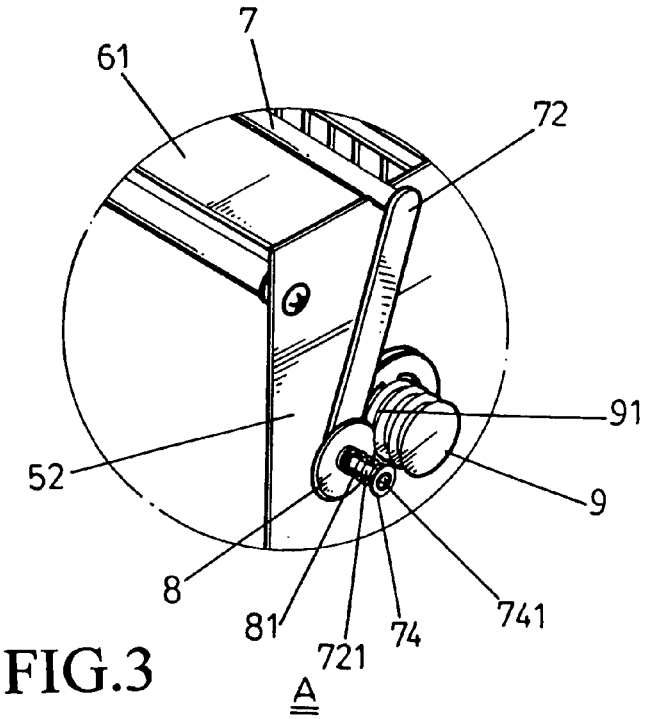
FIG. 3 shows a partial sectional view of the frame in FIG. 2 according to the invention.

The frame 61 of blade assembly 6 has two support bases 611 and 612 for receiving a spindle (or cam following shaft) 7 above. One end of the spindle 7 is penetrated into an opening 6121 of the support base 612, whereas the other end of the spindle 7 is connected to a lever 72 as shown in FIG. 3. At a portion of the spindle 7 near the opening 6121 is a pressing member (paper sensing lever) 73, which is tilted downward to extend into the shredder slot 50 of the two blade assemblies 5 and 6, such that when paper is entered into the shredder slot 50, the pressing member 73 is simultaneously pressed downward for driving and rotating the spindle 7. A bottom portion of the lever 72 is connected with a transverse shaft 721 accommodated by a circular roller (or cam follower) 8. An end of the shaft 721 is fastened with a circular baffle 74 using a screw bolt 741, and the roller 8 and the baffle 74 are separated by a spring 81 in between such that the roller 8 is allowed with displacement by pressing against the spring 81 as shown in FIG. 3. Extending from an outer side of the fixing plate 51 of the blade assembly 6 is a projecting helical gear (or helical cam) 9, which is connected to and rotates with the blade assembly 6. Gear grooves 91 on the helical gear 9 are for placing the roller 8.

Figure 4:
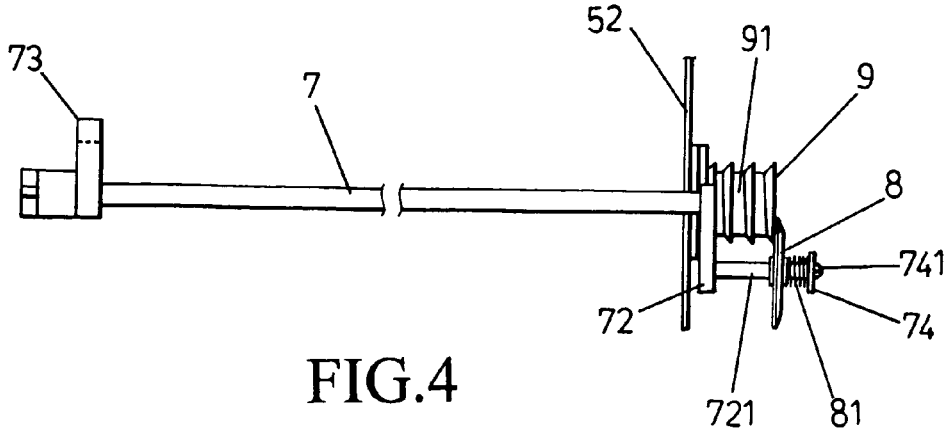
FIG. 4 shows a plan view illustrating the delaying device according to the invention not inserted with paper or having completed shredding.
Figure 5:
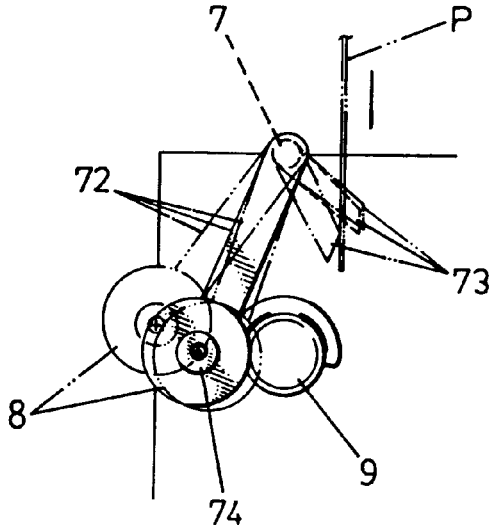
FIG. 5 shows a motional schematic side view of the spindle and the gear axis of the delaying device according to the invention.
Figure 6:
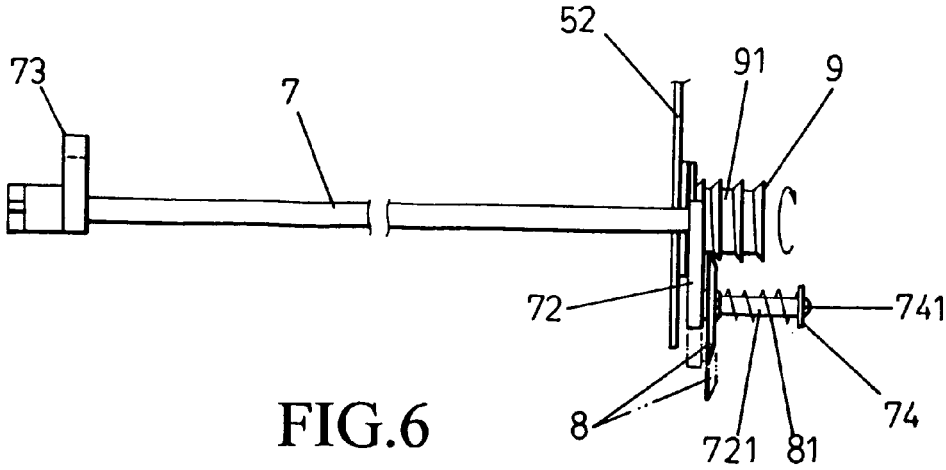
FIG. 6 shows a plan view illustrating the delaying device of FIG. 5.

Referring to FIGS. 4 and 5, when paper P is not inserted, the roller 8 is pressed against the spring 81 and blocks at (is retained against) an outer side of the gear 9, locating the lever 72 in a first position. When a paper P is inserted, the paper P downwardly presses the pressing member 73 that further rotates the spindle 7. Referring to FIG. 5, the roller 8 is displaced outward or upward by the paper P so as to depart from the gear 9, locating the lever 72 in a second position, and a restoring force or bias of the spring 81 pushes the roller 8 inward to the position shown in FIG. 6. It can be seen with reference to FIG. 5 that, with the lever 72 in the first position, the roller 8 is fully clear of the gear 9. When the paper P clears the pressing member 73 the spindle 7 rotates to bring the lever 72 into a third position wherein the roller 8 engages with the gear 9. The roller 8 is biased into engagement with the gear grooves 91 of the gear 9, and is pushed toward an outermost end of the gear 9 by rotation of the gear 9 by the shredding blade assembly 6, returning the roller 8 to the position of FIG. 4. At this point, the shredder comes to a halt for having completed shredding, thereby accomplishing the objects of delaying, as the roller 8 travels along the gear 9, and halting. Operation of an electrical switch, such as a microswitch, by a member such as the pressing member, a portion thereof, or a member in connection with the pressing member to switch the paper shredder on and off is well known in the art and is exemplified in U.S. Pat. Nos. 6,827,300, 6,308,904, 6,250,574, 5,984,215, 5,775,605, and 5,167,374.

Conclusive from the above, the invention utilizes an interlocking relationship between the spindle 7, the roller 8 and the helical gear 9 for accomplishing delaying and halting of the shredder, and advances over drawbacks such as short-circuits and malfunctions of electronic sensors and printed circuit boards in the prior shredder.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A mechanical delaying device in a paper shredder, the paper shredder comprising a base, an upper lid removably disposed on the base, the upper lid having a feeder passage defined therein, first and second rotatable blade assemblies contained within the base, the blade assemblies defining a paper-shredding passage there-between, the paper-shredding passage being generally in alignment with the feeder passage; a motor disposed in the base and operably coupled to the blade assemblies, the mechanical delaying device comprising:

a helical cam connected with and rotatable with one of said blade assemblies and having an outer end, said cam having an axially extending helical cam arrangement extending to an outer end of the cam;

a spindle disposed above said blade assemblies, the spindle having first and second ends;

a paper sensing lever extending radially from said spindle between said paper-shredding passage and said feeder passage, said lever arranged to rotate the spindle when engaged by paper fed to the feeder passage;

an arm rotatable with and extending radially from the first end of said spindle, the arm having an end proximate to said helical cam;

a shaft extending transversely from the end of said arm, the shaft lying generally alongside said helical cam;

a cam follower slidably disposed along said shaft, the cam follower being movable between a first position adjacent to said arm and a second position remote from said arm; and a compression spring disposed on said shaft, the compression spring biasing said cam follower toward said first position;

wherein said arm is movable between a first position in which said cam follower at least partially overlies the outer end of said helical cam, a second position in which said cam follower is entirely disengaged from and laterally located relative to said helical cam, and a third position in which said cam follower is engaged with said helical cam for axial movement therealong upon rotation of the cam until the follower reaches the cam outer end, whereupon the follower and cam are displaced to the first position; and wherein said motor is activated when said arm is in either of said second and third positions, and said motor is deactivated when said arm is in said first position.

2. A mechanical delaying device, comprising:

a base;

an upper lid removably disposed on said base, the upper lid having a feeder passage defined therein;

first and second rotatable blade assemblies contained within said base, the blade assemblies defining a paper-shredding passage there-between, the paper-shredding passage being generally in alignment with said feeder passage;

a motor disposed in said base;

a reducing gear set operably coupling said motor and said blade assemblies;

a helical cam connected with and rotatable with said first blade assembly and having an outer end, said cam having an axially extending helical cam arrangement extending to an outer end of the cam;

a spindle disposed above said first blade assembly, the spindle having first and second ends;

a paper sensing lever extending from said spindle between said paper-shredding passage and said feeder passage, said lever arranged to rotate the spindle when engaged by paper fed to the feeder passage;

an arm rotatable with and extending radially from the first end of said spindle, the arm having an end proximate to said helical cam;

a shaft extending transversely from the end of said arm, the shaft lying generally alongside said helical cam;

a cam follower slidably disposed along said shaft, the cam follower being movable between a first position adjacent to said arm and a second position remote from said arm; and a compression spring disposed on said shaft, the compression spring biasing said cam follower toward said first position;

wherein said arm is movable between a first position in which said cam follower at least partially overlies the outer end of said helical cam, a second position in which said cam follower is entirely disengaged from and laterally located relative to said helical cam, and a third position in which said cam follower is engaged with said helical cam for axial movement therealong upon rotation of the cam until the follower reaches the cam outer end, whereupon the follower and cam are displaced to the first position; and wherein said motor is activated when said arm is in either of said second and third positions, and said motor is deactivated when said arm is in said first position.

* * * * *